United States Patent [19]

Corneille

[11] 4,411,827

[45] Oct. 25, 1983

[54] COPRECIPITATION PROCESS FOR THERMIONIC CATHODE TYPE MATERIALS

[76] Inventor: David M. Corneille, 311 Granger, Dayton, Ohio 45433

[21] Appl. No.: 391,325

[22] Filed: Jun. 23, 1982

Related U.S. Application Data

[62] Division of Ser. No. 244,853, Mar. 18, 1981, Pat. No. 4,359,489.

[51] Int. Cl.[3] ..... H01B 1/06

[52] U.S. Cl. ..... 252/521; 427/77

[58] Field of Search ..... 427/77, 247, 372.2, 427/126.1; 252/521, 518, 244, 853; 313/346 R, 346 DC; 29/25.11, 25.14, 25.13, 25.17

[56] References Cited

U.S. PATENT DOCUMENTS

| | | | |
|---|---|---|---|
| 1,842,161 | 1/1932 | Fredenburgh | 252/521 |
| 2,545,695 | 3/1951 | Hagelston | 106/287 |
| 2,985,548 | 5/1961 | Blickwedel et al. | 427/77 |
| 3,719,856 | 3/1973 | Koppins | 313/346 R |
| 3,879,830 | 4/1975 | Buescher | 252/521 |
| 4,573,683 | 6/1981 | Kawamura | 252/521 |

OTHER PUBLICATIONS

Doyle et al., Chem. Abstracts, vol. 69, 2217z, 1968.
Bentley et al., Chem. Abstracts, vol. 75, 87977u, 1971.
Farbwerke; Hoechst, Chem. Abstracts, vol. 54, 4056d.

*Primary Examiner*—Josephine Barr
*Attorney, Agent, or Firm*—Donald J. Singer; William J. O'Brien

[57] ABSTRACT

A method for fabricating a homogenous and uniformly sized mixture of alkaline earth metal carbonates found to be especially useful as an emission type coating material for application to a cathodic element of a thermionic vacuum tube.

1 Claim, No Drawings

COPRECIPITATION PROCESS FOR THERMIONIC CATHODE TYPE MATERIALS

STATEMENT OF GOVERNMENT INTEREST

The invention described herein may be manufactured and used by or for the Government for governmental purposes without the payment of any royalty thereon.

This is a division of application Ser. No. 244,853, filed Mar. 18, 1981, now U.S. Pat. No. 4,359,489.

BACKGROUND OF THE INVENTION

This invention relates to thermionic cathodes and to a method for producing thermionic emitting materials for use therewith. In a more particular aspect, this invention concerns itself with a novel process for preparing a homogeneous mixture of finely divided alkaline earth carbonates especially adapted for use as an emission material for coating thermionic cathodes.

Thermionic vacuum tubes are well known electronic devices that rely on thermally emitted electrons from a heated electrode to produce tube current. The electrode is referred to as a cathode since it forms the negative electrode of the tube and is heated until it emits electrons. It can be heated directly by passing a current directly through the cathode or filament. Also, it can be heated indirectly by an independent heating element or ionic bombardment on the emitting surface.

Generally, the emitting surface is fabricated by applying an emitting material to the surface of a substrate as a coating rather than rely on the substrate material itself as the electron emitting portion of the tube. Since the emitting surface carries no heating current, there is no voltage drop along the surface. This fact, coupled with the high emission capabilities of the coated material, make the cathodes especially useful for modern day high power accelerations.

The successful utilization of thermionic tubes, however, depends to a great extent on the operational efficiency of the emitting cathode as well as the time consuming and expensive procedures which must be resorted to if an efficiently operating device is to be fabricated. For example, mixtures of alkaline earth carbonates have been found to be useful and efficient as thermionic cathode coating materials. However, such mixtures lack homogenity and particle size uniformity. One technique for overcoming this problem is to subject the carbonates to a severe ball milling procedure. Unfortunately, this expensive and time consuming procedure does not adequately overcome the problem of homogenity even though the resulting size of the carbonate particles is satisfactory.

With the present invention, however, it has been found that the problem of homogenity with respect to the mixtures compositional content and particle size uniformity can be overcome through the use of the coprecipitation procedure of this invention in which mixtures of suitable alkaline earth carbonates are dissolved in a solvent. The solvent is then driven off to leave a homogenous mixture of uniformity sized carbonate materials which are especially useful as an emission coating for a thermionic tube cathodic element.

SUMMARY OF THE INVENTION

The present invention is predicated upon the discovery that the compositional homogenity and particle size uniformity of finely divided alkaline earth carbonate mixtures can be significantly and unexpectedly improved through a novel coprecipitation process. The process comprises the steps of dissolving a plurality or mixture of alkaline earth metal carbonates, such as calcium carbonate, strontium carbonate and barium carbonate, in trifluorethanol; heating the carbonate containing solvent mixtures to a temperature and for a period of time sufficient to evaporate the solvent; and then recovering the resulting homogeneous mixture of uniformily dispersed, ultrafine particles.

Accordingly, the primary object of this invention is to provide a method for producing homogeneous mixtures of alkaline earth metal carbonates especially suitable for use as thermionic emission type coating materials.

Another object of this invention is to provide a method for producing a mixture of ultrafine, alkaline earth metal carbonate particles of uniform size and character.

Still another object of this invention is to provide a mixture of alkaline earth metal carbonates that can be easily and efficiently applied as an emission type coating material to the cathodic element of a thermionic vacuum tube.

The above and still other objects and advantages of the present invention will become more readily apparent upon consideration of the following detailed description thereof.

DESCRIPTION OF THE PREFERRED EMBODIMENTS

Pursuant to the above-defined objects, the present invention encompasses a novel method for effecting the coprecipitation of a mixture of alkaline earth metal carbonates that are found to be useful as emission type coating materials. The alkaline earth metal carbonates, such as calcium, strontium and barium carbonates, are prepared as finely divided powders. Generally, either singly or as mixtures, the carbonates in the form of a slurry are applied as a coating material to a platinum, tungsten or nickel substrate. The coated substrate is then utilized as the cathodic element in a thermionic vacuum tube. Unfortunately, the procedures relied upon heretofore do not produce powders of sufficient fineness, uniform size and character, and compositional homogenity.

With the above problem in mind, a research effort was undertaken with a view toward producing a homogeneous, uniform mixture of ultrafine alkaline earth metal carbonates. As a result of that research effort, it was found that the problems elucidated above could be overcome by a novel coprecipitation process. In essence, the process of this invention involves the steps of dissolving to the saturation point a suitable mixture of the alkaline earth carbonates into a trifluoroethanol solvent. This is followed by the step of heating the solvent mixture to a temperature and for a period of time sufficient to evaporate the solvent, thus leaving, as a precipitate, a homogeneous mixture of ultrafine particles of uniform size and character.

The process of this invention is equally applicable for dissolving any one of the alkaline earth metal carbonates or their mixtures. However, from a practical standpoint, only the individual barium carbonate or mixtures of barium and calcium, barium and strontium or barium, calcium and strontium are considered for this invention since it is unlikely that calcium or strontium alone would be used as an emission coating materials. For practical considerations, it has been found that carbonate mixtures in the range of 2 to 10 weight percent $CaCO_3$; 10 to 60 weight percent $SrCO_3$ with the balance substantially all $BaCO_3$ have proven to be most effective as an emission type coating material.

The invention is more specifically illustrated by the following example in which all percentages are considered to be weight percent unless otherwise indicated.

EXAMPLE

Approximately 0.5 grams of a triple carbonate mixture composed of about 4% $CaCO_3$, 27% $SrCO_3$ and 69% $BaCO_3$ was dissolved in about 100 ml of trifluoroethanol. The ingredients were placed in the reaction flask of a suitable device such as a conventional rotary vacuum evaporator. The solution was heated to about 60° C. for a period of approximately five minutes to evaporate the solvent. The resulting precipitate was recovered and found to be a homogeneous mixture of carbonate particles of approximately one micron diameter uniformily distributed throughout the mixture. If desired, the solvent can be evaporated without heat by resorting to a vacuum of about 10 inches in order to effect evaporation of the solvent.

Examples of other carbonate mixtures suitable for this invention and as efficient emission type coating materials can be found in the Table which follows:

TABLE

A.

$BaCO_3$—57.2%
$SrCO_3$—38.8%
$CaCO_3$—4.0%

B.

$BaCO_3$—100%

C.

$BaCO_3$—50%
$SrCO_3$—30%
$CaCO_3$—20%

D.

$BaCO_3$—10%
$CaCO_3$—90%

The carbonate mixtures resulting from this invention can be easily applied to a nickel or tungsten substrate using conventional slurry techniques. Also, the carbonate materials can be applied to a suitable porous substrate of nickel or tungsten by impregnating the porous surface through the method of alternately dipping the substrate into the solvent mixture and evaporating the solvent such that the ultrafine, homogeneous mixture of carbonates are deposited in situ into the pores of the substrate surface. The rate of precipitation can be accelerated by resorting to a partial vacuum. A suitable condensor arrangement can be used to recover the solvent, if desired.

The process of this invention can be carried out very economically using conventional equipment such as a rotary vacuum evaporation in order to recover the solvent. Since there is no chemical reaction taking place, there is significantly less chance for contamination and no significant purification steps are necessary. The coprecipitate is homogenous from a compositional standpoint and the particle size is of ultrafineness and uniformily distributed. Particle size distribution is more easily controlled without fear of affecting any chemical reaction taking place. Since the particle distribution and size is easily controlled, no other manufacturing procedure, such as ball milling, is necessary. This process allows for the fabrication of a truly coprecipitated mixture in which the materials are vertically totally uniform compositionally. It also allows the material to be produced at the proper powder particle size distribution for application to a cathode base as an emission type coating material. It eliminates the cumbersome and expensive task of the 24–72 hour ball milling process required heretofore.

Although the invention has been described by reference to a particular embodiment, it is to be understood by those skilled in the art that all the various modifications encompassed within the scope of the appended claims are intended to be included herein.

What is claimed is:

1. A method for producing a homogeneous mixture of uniformly sized, ultrafine, alkaline earth metal carbonates for use as a thermionic emission type coating material which comprises the steps of (1) forming a mixture of alkaline earth metal carbonates composed of about 2 to 10 weight percent calcium carbonate, 10 to 60 weight percent strontium carbonate and the balance barium carbonate; (2) dissolving said mixture in trifluoroethanol to form a solvent mixture; (3) heating said solvent mixture to a temperature of about 60° C. for a period of about five minutes to extract said solvent from said solvent mixture; and (4) recovering the resulting precipitate as a homogeneous, ultrafine mixture of alkaline earth metal carbonates of uniform size and distribution.

* * * * *